United States Patent [19]

Clark

[11] 4,204,573

[45] May 27, 1980

[54] HEAT EXCHANGER WITH CONCENTRIC FLOW TUBES

[75] Inventor: David W. Clark, Fort Worth, Tex.

[73] Assignee: PVI Industries, Inc., Fort Worth, Tex.

[21] Appl. No.: 795,204

[22] Filed: May 9, 1977

[51] Int. Cl.[2] ..... F28D 7/12

[52] U.S. Cl. ..... 165/142; 165/154; 165/160

[58] Field of Search ..... 165/142, 143, 145, 154, 165/159, 160, 161; 122/32

[56] References Cited

U.S. PATENT DOCUMENTS

| | | | |
|---|---|---|---|
| 367,839 | 8/1887 | Oakes | 165/160 |
| 1,862,310 | 6/1932 | How | 165/161 |
| 2,035,275 | 3/1936 | Pfau et al. | 165/160 |
| 2,491,618 | 12/1949 | Luetzelschwab | 165/159 |
| 3,948,315 | 4/1976 | Powell | 165/158 |
| 3,963,071 | 6/1976 | Levin et al. | 165/106 |

FOREIGN PATENT DOCUMENTS

| | | | |
|---|---|---|---|
| 491097 | 2/1930 | Fed. Rep. of Germany | 165/159 |

*Primary Examiner*—Carlton R. Croyle
*Assistant Examiner*—Thomas I. Ross
*Attorney, Agent, or Firm*—Robert A. Felsman

[57] ABSTRACT

A heat exchanger for heating liquids with other liquids or vapors. An inner flow tube is carried concentrically within an outer flow tube to define an inner passage and also an annular passage. A first manifold directs all of the incoming fluid from one fluid source to either the inner or annular passage. A second manifold directs all of the incoming cooler fluid from the other fluid source to the other passage. A third manifold at the other end of the outer tube discharges the fluid from it so that it does not mix with the inner tube fluid. The outer tube is immersed in inner tube fluid to cause heat transfer through the walls of the inner tube and outer tube.

6 Claims, 5 Drawing Figures

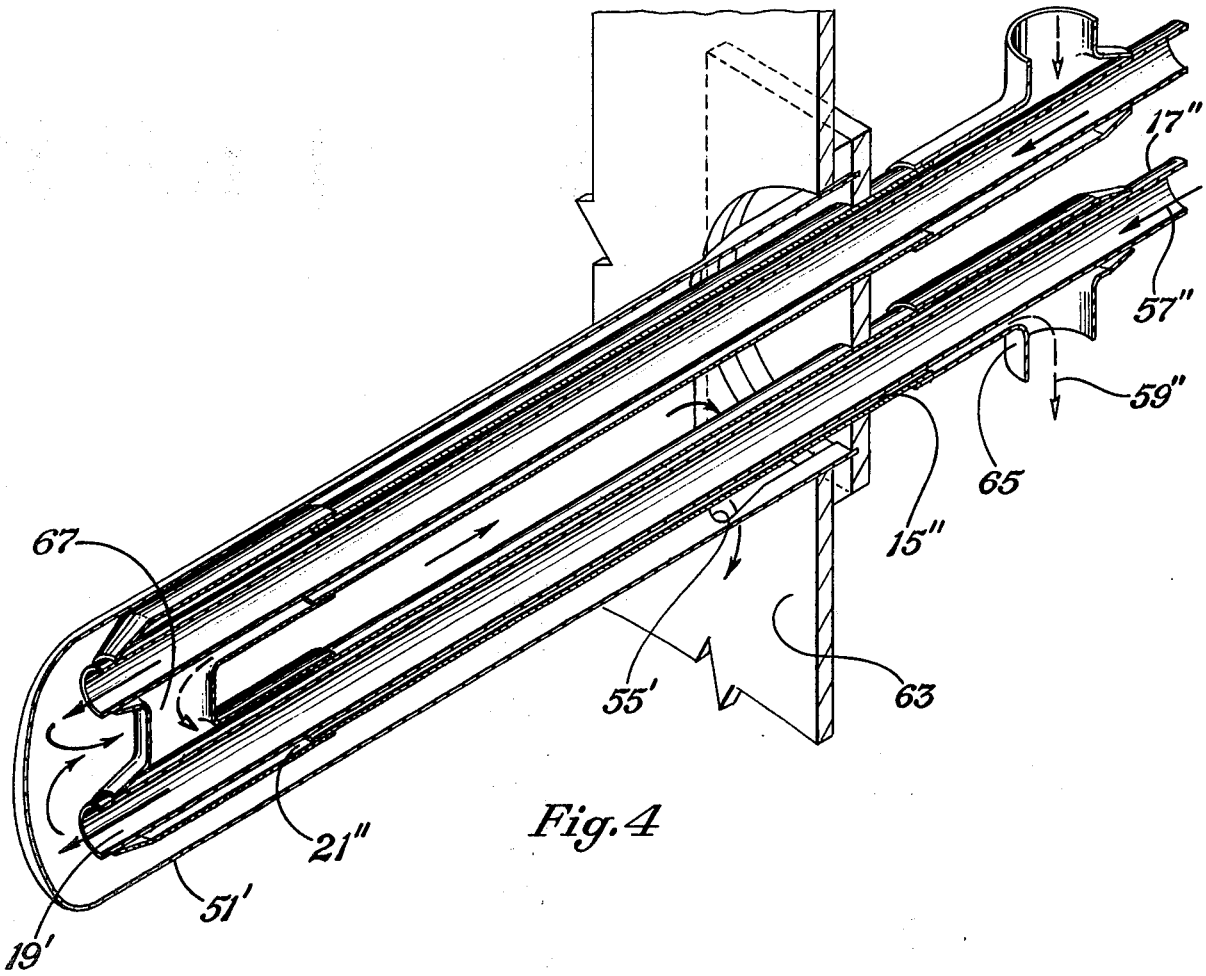
Fig. 4
Fig. 5
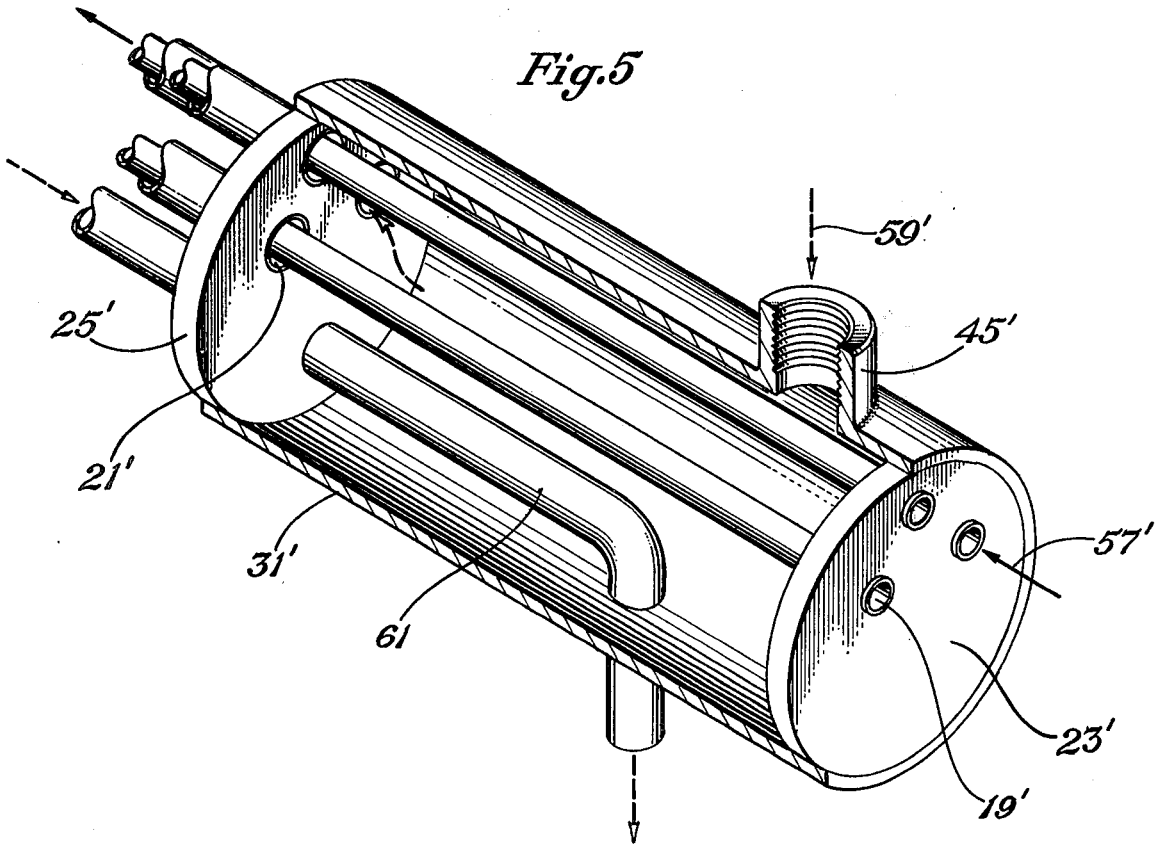

HEAT EXCHANGER WITH CONCENTRIC FLOW TUBES

BACKGROUND OF THE INVENTION

1. Field of the Invention

This invention relates in general to heat exchangers and in particular to an apparatus for heating liquid by use of either a liquid or a vapor.

2. Description of the Prior Art

Liquids have been heated by fluids such as steam or other hot liquids in various manners. It is known that heat transfer coefficients and the efficiency of the heat exchanger improve with the velocity of the fluids. One type of heat exchanger employing high flow rates uses concentric pipes. The cold liquid is forced through the inner pipe while steam is forced through the annular space. Heat is transferred from the steam through the walls of the inner pipe. However the heat transferred to the outer pipe walls is lost, since the liquid to be cooled is located only in the interior pipe.

In U.S. Pat. No. 403,123, a steam water heater is disclosed that uses a bundle of concentric tubes in a tank. Cold water flows up through the annular passage of some of the tube pairs and down the annular passages of others. Some of the steam flows up the inner tubes, while the remainder passes exterior of the outer tubes and out the top of the tank. The velocity of flow is reduced in the resultingly large steam flow areas. In addition, a portion of the steam flows over the cold water intake at a point where thermal stresses and expansion cannot be easily alleviated.

SUMMARY OF THE INVENTION

It is accordingly a general object of this invention to provide an improved apparatus for exchanging heat between two fluids.

It is a further object of this invention to provide an improved apparatus for exchanging heat between two fluids using concentric tubes and high velocity flow of each fluid to create high heat transfer coefficients on the walls of both tubes.

It is a further object of this invention to provide an improved apparatus for heating a liquid with another fluid that utilizes concentric tubes and avoids stresses due to thermal expansion.

In accordance with these objects, a heat exchanger is provided that contains concentric inner and outer tubes to define an inner passage and an annular passage. A first manifold directs a first fluid into the inner passage. A second manifold directs a second fluid into the annular passage to enable high velocity flow. A third manifold on the opposite end directs the second fluid from the annular passage out so that it will not mix with the first fluid of the inner passage. The exterior of the outer tube is immersed in the first fluid that flows through the inner passage. Thus, heat is transferred between the second fluid and the first fluid through the wall of the inner tube and simultaneously through the wall of the outer tube. None of the tubes are restrained from movement at their ends, allowing thermal stresses to be relieved.

BRIEF DESCRIPTION OF THE DRAWINGS

FIG. 4 is a perspective view, partially in section, of an alternate embodiment of a heat exchanger constructed in accordance with the teachings of this invention.

FIG. 5 is a perspective fragmentary view, partially in section, of another alternate embodiment of a heat exchanger constructed in accordance with the teachings of this invention.

DESCRIPTION OF THE PREFERRED EMBODIMENT

Figures 1, 3:
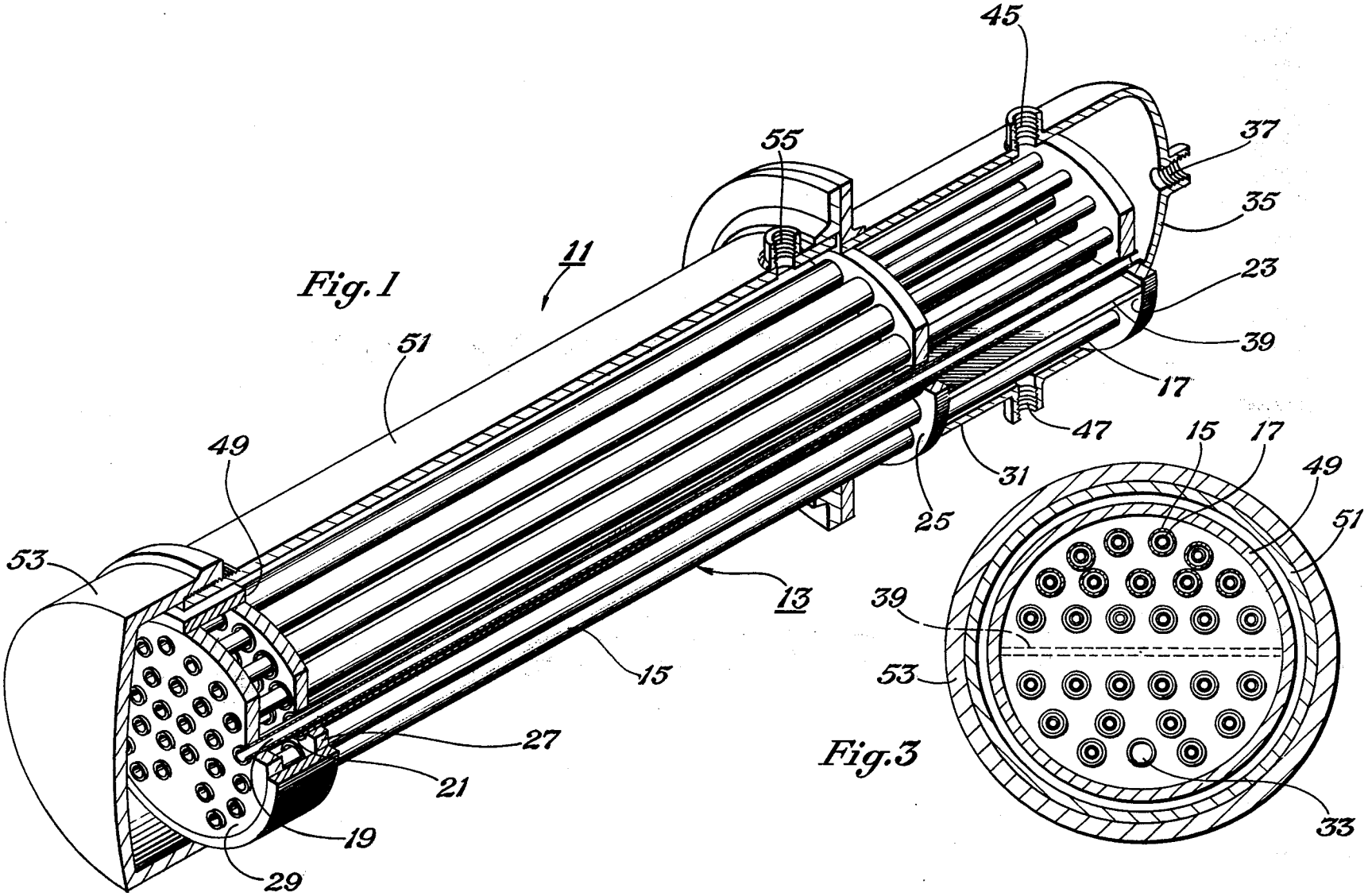
FIG. 1 is a perspective view, partially in section, of a heat exchanger constructed in accordance with the teachings of this invention.
FIG. 3 is a cross sectional view taken along the lines III—III of FIG. 2.
Figure 2:
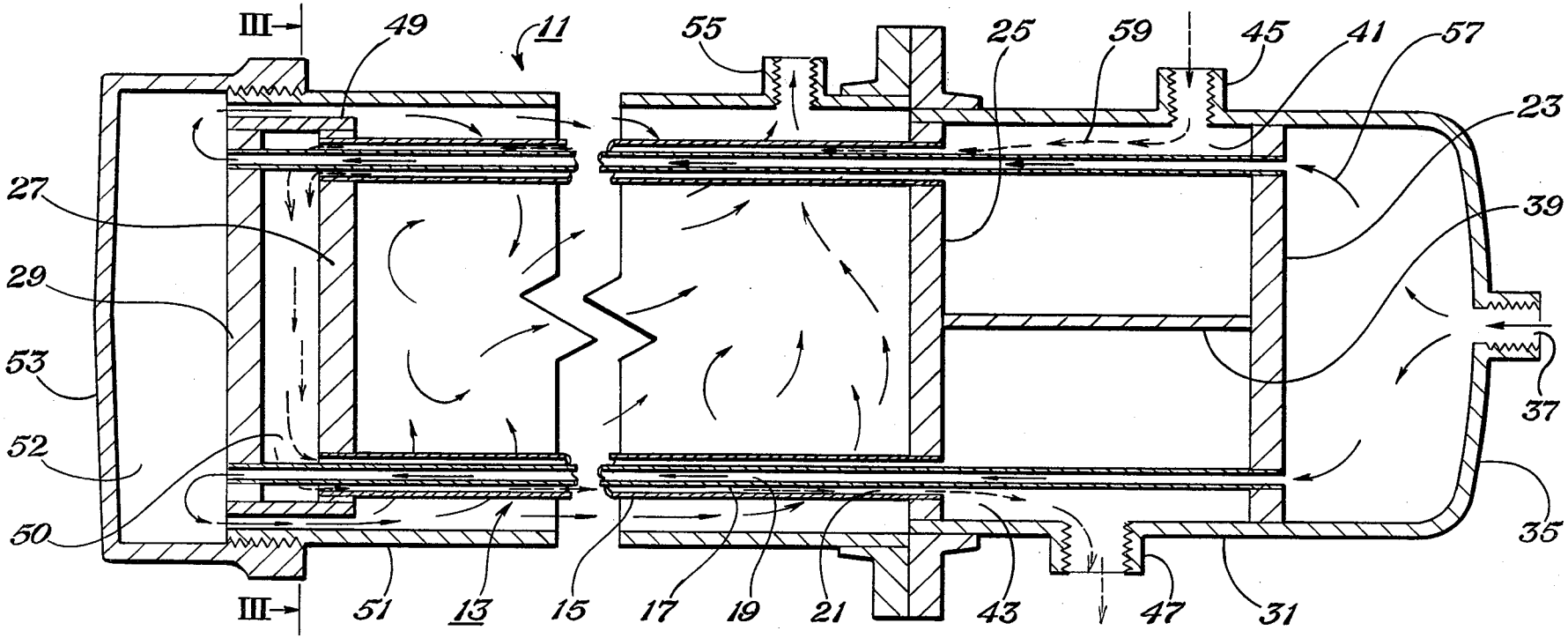
FIG. 2 is a cross sectional view taken along the longitudinal axis of the heat exchanger of FIG. 1.

Referring to FIGS. 1 through 3, a heat exchanger 11 is shown. The heat exchanger 11 has a plurality of concentric tubes or tube-pairs 13 spaced in a bundle. Referring to FIG. 2, each tube-pair comprises an outer tube 15 within which an inner tube 17 is carried, defining an inner passage 19 and an annular passage 21.

These tube-pairs 13 are carried in a bundle by four partitions or tube sheets. The first partition 23 is located on the first end and comprises a circular plate with apertures for sealingly receiving the inner tubes 17. The second partition 25 is spaced from the first partition 23 and comprises a circular plate with apertures for sealingly receiving the outer tubes 15, which terminate at this plate. The third partition 27 is identical to the second partition 25, comprising a plate with apertures for receiving the outer tubes 15, whose second ends terminate at partition 27. The fourth partition 29 is spaced substantially at the second end of the heat exchanger and, similar to the first partition 23, has apertures for sealingly receiving inner tubes 17. Consequently the inner tubes 17 extend from the first to the fourth partitions, while the outer tubes 15 extend from the second to the third partitions. As shown in FIG. 3, one bottom tube 33 does not contain an inner tube, to facilitate flow of condensate if steam is used as the heating medium.

The first partition 23 and second partition 25 are sealingly enclosed in a cup-shaped housing 31, with the mouth of the housing at the second partition 25 and the closed end 35 of the housing spaced away from the first partition 23 a short distance. An inlet 37 is located in the center of the closed end 35 of housing 31 for receiving incoming fluid, normally water to be heated. Consequently the closed end 35, inlet 37, and partition 23 serve as first manifold means for directing all of the incoming first fluid to the inner passages 19.

A baffle 39 extends between the first and second partitions 23, 25 perpendicular to them and parallel with the tube-pairs 13. Baffle 39 is a solid plate sealingly secured to the first and second partitions and located approximately midway in the bundle. Baffle 39 divides the space enclosed by housing 31 into two separate chambers, designated as intake chamber 41 and discharge chamber 43. An inlet 45 is located in housing 31 on the side in communication with intake chamber 41. Inlet 45 is connected to the source of the second fluid, thus serves with intake chamber 41 as second manifold means for directing all of the second fluid to the annular passages 21.

An outlet 47 is located in housing 31 in communication with the discharge chamber 43. Outlet 47 is connected to the return or downstream side of the second fluid source. A cylindrical housing 49 sealingly encloses the space between the third and fourth partitions 27, 29, defining a reversing chamber 50, which in combination with the discharge chamber 43, outlet 47 and interconnecting annular passages 21, serve as third manifold means for directing second fluid out of the heat exchanger 11.

A cylindrical housing or jacket 51 has a closed end 53 at the second end of the heat exchanger 11, and extends the length of the concentric tubes 13, terminating at the second partition 25. A reversing chamber 52 is defined by the space between closed end 53 and the fourth partition 29. The only outlet in jacket 51 is outlet 55, located approximately at the first end of the concentric tubes 13, near partition 25. There is a clearance between housing 49 and jacket 51, causing the outer tubes 15 to be immersed in the first fluid of the inner passage 19 as the fluid flows toward outlet 55. Baffles could be spaced between the jacket 51 and the concentric tubes 13 to increase the velocity in this area by causing the first fluid to flow out in an "S" pattern.

In the operation of the heat exchanger of FIGS. 1 through 3, a liquid may be used to heat a liquid, or a vapor such as steam may be used for heating the liquid. Preferably the liquid to be heated enters inlet 37, and as shown by a solid-line arrows 57 of FIG. 2, passes from the first manifold to all of the inner passages 19. This liquid is discharged at the second end and reverses its direction of flow in reversing chamber 52. It then passes through the space between jacket 51 and the tube bundle, then out outlet 55, immersing substantially the entire length of the outer tubes 15 in the liquid.

Steam enters through inlet 45 into intake chamber 41, then passes into the annular passages 21 that are in communication with the intake chamber 41, as shown by the dotted-line arrows 59 of FIG. 2. Heat from the steam is transferred to the water across the walls of the inner tubes 17 and across the walls of the outer tubes 15. When the steam reaches the reversing chamber 50, the direction of flow is reversed, returning the steam in the outer tubes 15 that terminate at the discharge chamber 43. Steam flows through these passages, exchanging heat with water in the inner passages 19 and on the exterior of the outer tubes 15. Condensate flows through tube 33 to discharge chamber 43. The remaining steam and condensate are discharged through outlet 47.

The tubes are allowed to expand and contract due to thermal changes, since the third and fourth partitions are not attached to jacket 51. The first and second partitions 23, 25 are attached to housing 31, but the inner tubes 17 merely pass through the second partition 25 and are not connected to it so as to restrain expansion.

A heat exchanger constructed as shown in FIG. 1 was tested, resulting in an increase of water temperature from 60° F. to 100° F. with steam as the heating fluid. Thirty eight gallons per minute of water was flowing at six feet per second in inner passages 19 and the steam pressure was fifteen pounds gauge pressure per square inch at an altitude of 600 feet above sea level. Thirteen tube-pairs 13 were used with ½ inch O.D. inner tubes 17 and ¾ inch O.D. outer tubes 15. The length of the heat exchanger was 35 inches, and the diameter of jacket 51 was four inches. The clearance between the housing 49 and the jacket 51 was ¼ inch, and segmental baffles were placed in the spaces between the concentric tubes and the jacket at four inch intervals.

The apparatus disclosed will also function if the passages for the heating fluid and the liquid to be heated are interchanged. The hotter or first fluid can enter through inlet 37 into the inner passages 19, and the liquid to be heated or second fluid can pass through the annular passages 21. Also the directions of flow of one or both fluids can be reversed. The first fluid can enter outlet 55 of the jacket, flow over the outer tubes 15, reverse in reversing chamber 52 then pass through the inner passages 19 from the second end to the first end. In that case the first manifold means for directing incoming first fluid to the inner passages 19 would comprise outlet 55, partition 29, and jacket 51. The second fluid could also flow in reverse. If so, the second manifold means for directing incoming second fluid into the annular passages would include discharge chamber 43 and outlet 47. However, if steam is used as the second fluid, an outlet on the bottom for condensate should be provided, and the steam should preferably enter from an upper outlet. If the second fluid flow is reversed, the third manifold means for directing second fluid out of the heat exchanger would include reversing chamber 50, the interconnecting annular passages 21 with the intake chamber 41, and outlet 45.

FIGS. 4 and 5 disclose alternate embodiments. The embodiment of FIG. 5 is designed particularly for heating a liquid by steam. A single discharge conduit 61 extends from the third partition (not shown) through the second partition 25', thence out of the housing 31', which encloses the space between first and second partitions 23', 25'. An inlet 45' in housing 31' provides communication for the steam to annular passages 21', as shown by the dotted-line arrows 59'. Water enters inner passages 19' by a first manifold (not shown) similar to that in the embodiment of FIGS. 1 through 3, as shown by the solid-line arrows 57'. This embodiment does not require a baffle between the first and second partitions 23', 25' because of conduit 61, which serves as part of the third manifold means for directing second fluid out of the heat exchanger. The steam exchanges heat primarily when in the annular passages 21'.

FIG. 4 discloses an embodiment primarily for use in a storage tank 63, with most of the length of the concentric tubes being on the interior of the tank and surrounded by liquid discharged from the inner passages. The inner tubes 17'' extend parallel to each other and are connected by conventional means to the liquid to be heated. Outer tubes 15'' are connected by conventional L-shaped fittings 65 to the source and return of the heating fluid. At the second or interior end of the heat exchanger, the outer tubes 15'' are closed and connected together by a passage 67. A jacket 51', with a closed interior end, extends around the concentric tubes and terminates at the wall of the storage tank 63. An outlet 55' is provided in jacket 51' at the tank 63 wall to allow fluid discharged from the inner passage 19' to flow into the storage tank.

In operation, the liquid to be heated enters the inner passage 19' of each concentric tube as shown by the solid-line arrows 57''. After heating, the fluid discharges from the second end, flows back over the outer tubes 15'' within jacket 51', and then out into storage tank 63. The heating fluid enters one of the inlet connections 65 and flows through one of the annular passages 21'', as shown by the dotted-line arrows 59'', with connection 65 serving as the second manifold. The second fluid enters passage 67 at the second end and flows back down into the other annular passage 21'' and out connection 65, this connection and passage 67 serving as the third manifold means. Heat is exchanged through the walls of the inner tube 17'' and outer tube 15''. Since the heat exchanger of this embodiment is suspended only at a point intermediate its ends, the concentric tubes are free to expand and contract due to thermal changes.

It should be apparent that an invention having significant improvements has been provided. By forcing all of the incoming fluids through the inner and annular passages of the concentric tubes, both fluids can flow at high velocities. Greater efficiency is achieved by immersing the outer tubes in the fluid of the inner passage, causing heat to be transferred across the walls of both the inner and outer tubes. This is particularly efficient when using the jacket, which reverses the direction of flow of the fluid of the inner tube and causes fluid flow back across the outer tubes. The ends of the concentric tube-pairs are not restrained, allowing change in length due to thermal changes.

Having described the invention in connection with certain embodiments thereof, it should be apparent to those skilled in the art that it is not so limited but is susceptible to various changes and modifications without departing from the spirit thereof.

We claim:

1. An apparatus for exchanging heat between two fluids comprising:

at least one inner tube spaced concentrically in an outer tube, defining an inner passage and an annular passage;

first manifold means located at the first end of the apparatus for directing all of the incoming first fluid to the inlet of the inner passage; the first manifold means comprising a first partition at the first end of the apparatus having an aperture for sealingly receiving the inlet of the inner tube; and a first housing having a closed end and sealingly secured to the first partition, with an inlet on its closed end for receiving first fluid and directing all of it to the inlet of the inner tube;

second manifold means located at the first end of the apparatus for directing all of the incoming second fluid to the inlet of the annular passage; the second manifold means comprising a second partition spaced from the first partition and having an aperture for sealingly receiving the inlet of the outer tube; and a second housing sealingly enclosing the space between the first and second partitions and having an inlet for receiving second fluid and directing it to the inlet of the outer tube;

third manifold means at the second end of the apparatus for directing discharged second fluid out of the apparatus, including a discharge conduit extending from the second end of the apparatus back to the first end of the apparatus; the third manifold means comprising a third partition at the second end of the apparatus, having an aperture for sealingly receiving the outlet of the inner tube; a fourth partition spaced from the third partition and having an aperture for sealingly receiving the outlet of the outer tube and an aperture for sealingly receiving the inlet of the discharge conduit, the discharge conduit extending through the second partition and discharging second fluid exterior of the housing; and a third housing sealingly enclosing the space between the third and fourth partitions to direct second fluid from the outlet of the outer tube to the inlet of the discharge tube; and a jacket having a closed end enclosing substantially the length of the outer tube and having an outlet spaced close to the inlet of the annular passage, but separated from it, so as to cause the discharged first fluid to flow over the outer tube, exchanging heat through the walls of the inner and outer tubes.

2. An apparatus for exchanging heat between two fluids flowing at different temperatures, comprising:

at least two tube-pairs spaced apart and parallel with each other, each tube-pair having an inner tube spaced concentrically in an outer tube, defining an inner passage and an annular passage;

first manifold means at the first end of the apparatus for directing all of the incoming first fluid to the inner passage of each tube-pair;

second manifold means at the first end of the apparatus for directing all of the incoming second fluid to the annular passage of one of the tube-pairs;

third manifold means for placing the ends of the annular passage at the second end of the apparatus in communication with each other, causing incoming second fluid to flow out of the annular passage of one tube-pair into the annular passage of the other tube-pair, the third manifold means further separating the incoming second fluid from the discharging second fluid at the first end of the apparatus; and a jacket having a closed end on the second end of the apparatus enclosing a substantial portion of the tube-pairs and having an outlet spaced a selected distance from the second end so as to cause discharged first fluid flow over the outer tubes, further transferring heat;

the first manifold means comprising:

a first partition at the first end of the apparatus having an aperture for sealingly receiving the inner tubes; and a cup-shaped first housing sealingly secured to the first partition with an inlet for receiving first fluid and directing all of it to the inner passages of the inner tubes;

the second manifold means comprising:

a second partition spaced from and parallel to the first partition and having an aperture for sealingly receiving the first end of the annular passage of one tube-pair; and a second housing sealingly enclosing the space between the first and second partitions with an inlet for receiving second fluid and directing it to the annular passage;

the third manifold means comprising:

a third partition at the second end of the apparatus having an aperture for sealingly receiving the outlet of the inner tube;

a fourth partition spaced from and parallel with the third partition and having an aperture for sealingly receiving the second end of the outer tube of each tube-pair;

a third housing sealingly enclosing the space between the third and fourth partitions to direct discharged second fluid from the annular passage of one tube-pair to the annular passage of the other tube-pair, the outer tube of the tube-pair that receives the discharged second fluid being sealingly received in an aperture in the second partition; and a baffle extending between the first and second partitions transverse to them to divide the space enclosed by the second housing into intake and discharge chambers, the second housing having an outlet in the discharge chamber for discharging second fluid.

3. An apparatus for heating a liquid with a fluid, comprising:

two tube-pairs spaced parallel with each other and mounted in the wall of a storage tank with a substantial portion of their lengths located in the tank, each tube-pair having a single inner tube carried concentrically within a single outer tube;

the inner tube in each tube-pair being connected exterior of the tank to the source of the liquid, and being open at their interior ends for discharging the liquid;

the outer tube in one tube-pair being connected exterior of the tank to the source of the heating fluid, the interior ends of the outer tube of each tube-pair being connected together to return the heating fluid through the outer tube of the other tube-pair, this outer tube being connected exterior of the tank to a return for the heating fluid; and a jacket extending from the interior wall of the tank and enclosing the tube-pairs, the jacket having a closed end surrounding the interior ends of the tube-pairs but separated from the interior ends for receiving the discharge of liquid from the inner tubes and reversing the direction of flow, and an outlet located substantially at the wall of the tank so as to direct the discharged liquid over the outer tubes from the interior ends toward the wall, then through the outlet and into the tank, further exchanging heat with the heating fluid in the outer tubes.

4. An apparatus for exchanging heat between two fluids, comprising:

two tube-pairs spaced parallel with each other, each tube-pair having a single outer tube and a single inner tube carried concentrically in the outer tube;

each inner and outer tube having a first end and a second end;

first manifold means for directing all of the incoming first fluid to the first end of each inner tube; the second end of each inner tube being open for discharging first fluid;

second manifold means for directing all of the incoming second fluid to the first end of one of the outer tubes so as to flow through the outer tube from the first end to the second end; the first end of the outer tube in the other tube-pair being an outlet for discharging second fluid;

third manifold means connecting the second ends of the outer tubes together for directing the second fluid from one outer tube to the other outer tube to proceed to the outlet at the first end;

a jacket enclosing a substantial part of the tube-pairs, the jacket having a closed end surrounding the second ends of the tube-pairs for receiving the discharge of first fluid from the second ends of the inner tubes, the jacket having an outlet that is spaced from the second ends of the inner tubes a substantial distance for causing first fluid discharged from the inner tubes to flow back over the outer tubes toward the first ends, then out the outlet, further exchanging heat with the second fluid flowing through the outer tubes.

5. An apparatus for exchanging heat between two fluids, comprising:

two tube-pairs spaced parallel with each other, each tube-pair having a single outer tube and a single inner tube carried concentrically in the outer tube;

each inner and outer tube having a first end and a second end;

first manifold means for directing all of the incoming first fluid to the first end of each inner tube; the second end of each inner tube being open for discharging first fluid;

second manifold means for directing all of the incoming second fluid to the first end of one of the outer tubes so as to flow through the outer tube from the first end to the second end; the first end of the outer tube in the other tube-pair being an outlet for discharging second fluid;

third manifold means connecting the second ends of the outer tubes together for directing the second fluid through the outer tube of the other tube-pair from the second end back to the first end and the outlet;

a jacket enclosing a substantial part of the tube-pairs, the jacket having a closed end surrounding the second ends of the tube-pairs for receiving the discharge of first fluid from the second ends of the inner tubes, the jacket having an outlet means at the first end of the jacket for forcing all of the discharged first fluid to reverse its direction of flow and flow back over the outer tubes from the second ends toward the first ends and to the outlet means, further exchanging heat with the second fluid flowing through the outer tubes;

the third manifold means being free of attachment to the jacket to allow thermal expansion and contracting of the tube-pairs.

6. The apparatus according to claim 5 wherein the second ends of the outer tubes are sealed to the inner tubes and wherein the third manifold means comprises a passage between the second ends of the outer tubes.

* * * * *